United States Patent [19]

Billingham et al.

[11] Patent Number: 4,965,932

[45] Date of Patent: Oct. 30, 1990

[54] METHOD AND APPARATUS FOR ATTACHING A CONNECTOR

[75] Inventors: Kenneth H. Billingham, Feasterville, Pa.; James E. Franks, Lindenwold, N.J.; Ivan Pawlenko, Holland; Frank J. Schiller, Yardley, both of Pa.; Alexander Shemarovsky, Robbinsville, N.J.

[73] Assignee: AT&T Bell Laboratories, Murray Hill, N.J.

[21] Appl. No.: 468,419

[22] Filed: Jan. 22, 1990

Related U.S. Application Data

[62] Division of Ser. No. 317,262, Feb. 27, 1989, Pat. No. 4,903,399.

[51] Int. Cl.[5] ..... H01R 43/04

[52] U.S. Cl. ..... 29/861; 29/749; 29/753

[58] Field of Search ..... 29/749, 748, 751, 753, 29/759, 564.1, 564.6, 564.8, 566.3, 566.4, 861

[56] References Cited

U.S. PATENT DOCUMENTS

| | | | |
|---|---|---|---|
| 3,766,622 | 10/1973 | Brehm et al. | 29/56.5 |
| 3,995,358 | 12/1976 | Long et al. | 29/749 X |
| 4,006,519 | 2/1977 | Long et al. | 29/749 |
| 4,014,087 | 3/1977 | Cover et al. | 29/721 |
| 4,034,472 | 7/1977 | Cover et al. | 29/749 |
| 4,517,718 | 5/1985 | Johnson, Jr. | 29/749 X |

*Primary Examiner*—Carl E. Hall

*Attorney, Agent, or Firm*—Robert B. Levy

[57] ABSTRACT

An apparatus for attaching each of a successive pair of wires (12) to each of a pair of contacts (13), seated in opposed recesses (14) in a connector (16). The apparatus comprises a base (18) on which a connector-carrying carriage (26) is slidably mounted for movement along an axis (24). Each of a pair of ram assemblies (32) is mounted on opposite sides of the path of travel of the carriage (26). Adjacent to each ram assembly (32) is a wire guide (58) which has an upwardly inclined pin (74) which provides a path for pulling a wire into alignment with a separate one of the ram assemblies (32). Once aligned with the ram assemblies, the wires (12) are then rammed by the ram assemblies against the corresponding contacts (13).

2 Claims, 5 Drawing Sheets

METHOD AND APPARATUS FOR ATTACHING A CONNECTOR

This is a division of application Ser. No. 317,262 filed Feb. 27, 1989, now U.S. Pat. No. 4,903,399.

TECHNICAL FIELD

This invention relates to a method and apparatus for attaching successive pairs of wires to successive pairs of contacts of a connector.

BACKGROUND OF THE INVENTION

Within the telecommunications industry, "ribbon-type" connectors are widely used for connecting multi-conductor cables to electrical equipment. A typical ribbon connector is comprised of a prismatically-shaped, insulative block which carries two parallel rows of spaced electrical contacts. Each of the contacts in each row has mating portion at one end for mating with a contact on a complementary jack. Opposite the mating portion on each contact is a terminating portion which is exposed through a separate one of a plurality of recesses, each lying in a row along a separate one of a pair of opposed, longitudinal faces of the block. The terminating portion of each contact carries at least one barb for piercing the insulation of a wire rammed into the recess. Once the barb has completely pierced the insulation about the wire, an electrical connection is made between the wire and the contact.

Attachment of a pair of ribbon connectors to a multi-conductor cable usually occurs at the facility where the cable is manufactured. At such facilities, a machine of the type disclosed in U.S. Pat. No. 4,034,472, issued on Jul. 12, 1977, in the name of William S. Cover et al., may be used to attach successive pairs of wires of the cable to successive pairs of contacts of the connector. While the connector attachment machine disclosed in the Cover et al. patent generally operates satisfactorily, the machine is relatively expensive and bulky, and hence, is not well suited for field use.

In U.S. patent application, Ser. No. 290,551, filed in the name of M. Muhlberger et al. on Dec. 27, 1988, and assigned to AT&T (incorporated by reference herein), there is disclosed an apparatus for attaching successive pairs of wires in a cable to successive pairs of contacts of a ribbon connector. The Muhlberger et al. apparatus is much less complex than that of Cover et al. and is well suited for field use. However, the Muhlberger et al. apparatus incurs the disadvantage that it cannot accommodate some types of ribbon connectors. As described in the aforementioned application, the Muhlberger et al. apparatus employs a pair of fixed-stroke rams, each serving to ram one of a pair of wires into one of the pair of recesses in the connector to engage the contact therein. The fixed stroke of the rams of the Muhlberger et al. apparatus is too long for some types of ribbon connectors and can distort the contacts in the connector. In addition, each of the wire guides on the Muhlberger et al. apparatus, for guiding a separate one of a pair of wires in alignment with each ram, can be inconvenient to use.

Thus, there is a need for an apparatus capable of attaching successive pairs of wires to successive pairs of contacts on a ribbon connector without the aforementioned disadvantages.

SUMMARY OF THE INVENTION

Briefly, in accordance with the present invention, an apparatus is provided for attaching successive pairs of wires in a cable to successive pairs of contacts, seated in opposed recesses in a ribbon connector. The apparatus includes a connector-carrying carriage slidably mounted to a base for travel along a longitudinal axis. Each of a pair of ram assemblies, having an adjustable stroke, is mounted to the base on opposite sides of the carriage for ramming a separate one of a pair of wires into a separate one of opposed recesses in the connector. The stroke of each ram assembly is adjusted at the outset of operation in accordance with the depth of the connector recesses to prevent damage to the connector. Each of a pair of wire guides is situated adjacent to a separate one of the ram assemblies and includes a member, typically a pin, extending from a block at an upwardly inclined angle opposite to the pin of the other guide. Each pin serves to guide a wire, pulled downwardly therealong at an angle by an operator, against the block so that the wire can then be pulled by the operator downwardly against the block and into alignment with the ram. Means are provided for displacing the carriage along its axis to align each of a successive pair of recesses in the connector with a separate one of the rams.

DETAILED DESCRIPTION

Figure 1:
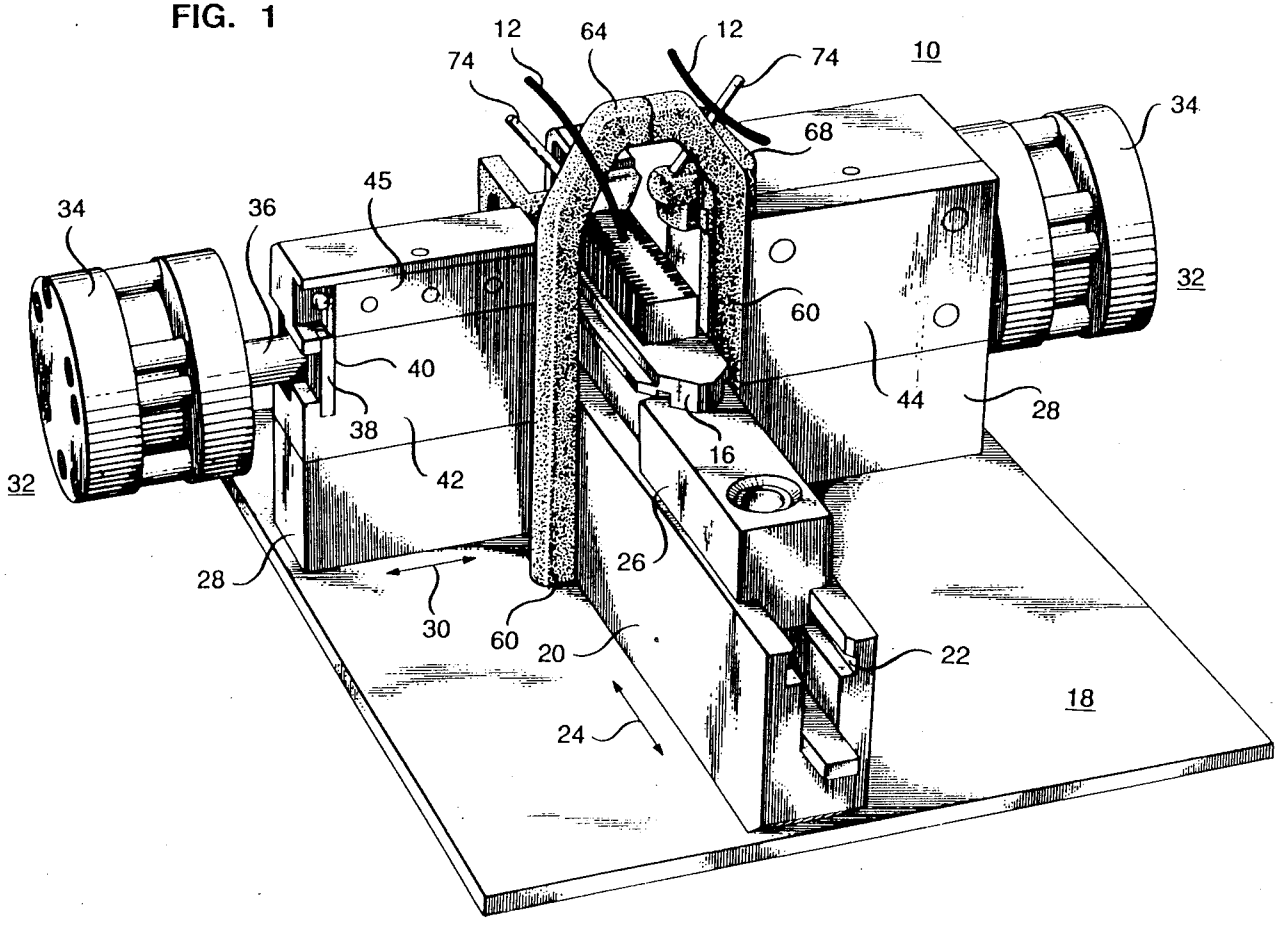
FIG. 1 is a perspective view of an apparatus, in accordance with the invention, for attaching successive pairs of wires to successive pairs of contacts of a connector.

FIG. 1 is a perspective view of an apparatus 10, in accordance with the invention, for attaching each of a successive pair of wires 12 (only one pair shown) to each of a pair of contacts 13 seated in opposed recesses 14 arranged in two parallel rows on a connector 16. The apparatus 10 comprises a base 18 which takes the form of a plate of aluminum or the like. Secured to the base 18 is an upwardly rising, long wall 20 which has a channel 22 in its top surface running the length of the long wall along an axis 24. A carriage 26 slidably engages the channel 22 for displacement along the axis 24 in a manner described in greater detail with respect to FIGS. 8 and 9. The carriage 26 of FIG. 1 serves to releasably engage the connector 16 so that the two rows of recesses 14 are each parallel to the axis 24.

Each of a pair of vertical cross walls 28, of a height greater than the long wall 20, is secured to the base 18 so as to run from a separate one of the longitudinal sides of the long wall in opposite directions along an axis 30 perpendicular to the axis 24. The cross walls 28 each carry one of a pair of opposing ram assemblies 32. As will be described in greater detail below, each ram assembly 32 serves to ram a separate one of the pair of the wires 12 into a separate one of a pair of opposed recesses 14 to attach each wire to the contact 13 in the recess.

Figure 2:
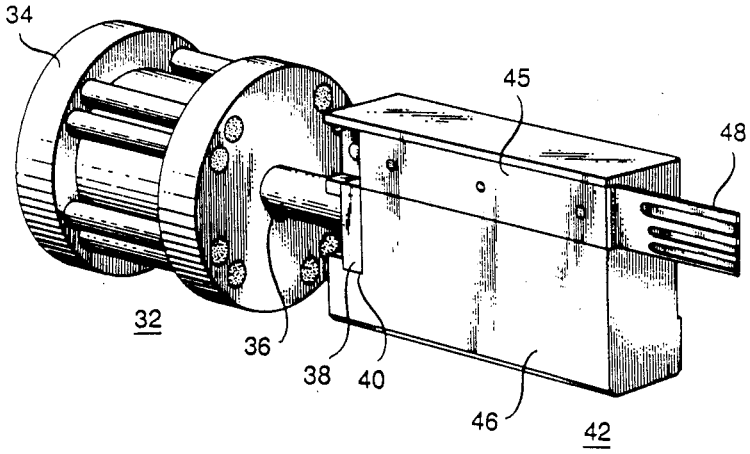
FIG. 2 is a partial perspective view of a portion of a ram assembly on the apparatus of FIG. 1.

Referring to FIGS. 1 and 2, each ram assembly 32 comprises an actuator 34, typically a pneumatic cylinder, which, as seen in FIG. 1, is attached to the end of the cross wall distant from the long wall 20. The actuator 34 has a shaft 36 which extends laterally into the cross wall 28 in a direction parallel to the axis 30. At the end of the shaft 36 distant from the actuator 34 there is a prismatic plate 38 which is sized for receipt in a passage 40 in one end of a block 42. As seen in FIG. 1, the block 42 is slidably mounted in an opening in a first longitudinal face 43 of the cross 28 for movement along the axis 30. The opening in the side 43 of each cross wall 28 is sealed by a cover 44.

Figure 3:
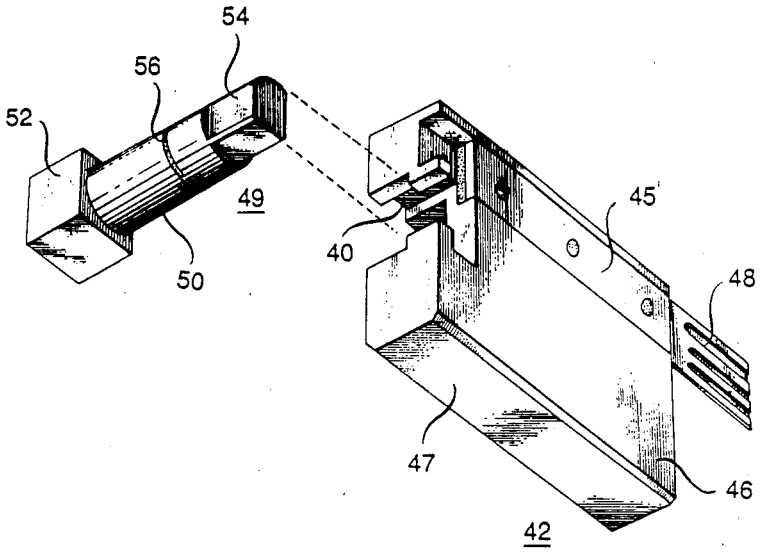
FIG. 3 is another perspective view of a portion of the ram assembly showing some of the details of a stop member for limiting the travel of the ram assembly.

As best seen in FIGS. 2 and 3, a blade 45 is secured to one of a pair of opposed longitudinal faces 46 and 47 of the block 42 so as to extend beyond the block towards the connector 16 of FIG. 1. Referring to FIG. 1, the length of the blade 45, and its height on the block 42, are chosen so that when the block is displaced toward the connector 16, the blade enters the recess 14 aligned therewith. As seen in FIGS. 2 and 3, the end of the blade 45 distant from the block 42 is provided with a set of serrations 48 which enable the blade to cut whatever excess portion of the wire 12 of FIG. 1 remains when the wire is rammed into the recess 14 of FIG. 1.

Figure 4:
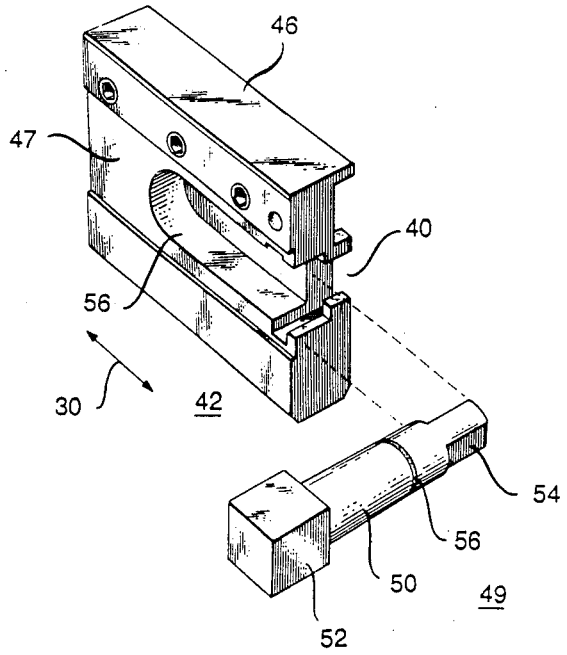
FIG. 4 is another perspective view of a portion of the ram assembly of FIG. 2 also showing some of the details of the stop member of FIG. 3.
Figure 5:
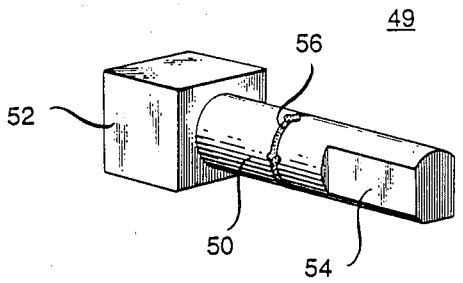
FIG. 5 is a perspective view of the stop member by itself.

Referring to FIGS. 3–5, the travel of the block 42 towards the connector 16 (see FIG. 1) is controlled by a stop member 49 comprised of a cylindrical body 50 having a prismatically- shaped head 52 at one end thereof. At the end of the body 50 opposite the head 52 is a set of flats 54 ground into the periphery of the body at different depths. The flats 54 are equidistant from the head 52 and are each aligned with a separate one of its faces.

Although not shown in FIG. 1, the body 50 of the stop member 49 is rotatably journaled in an opening in the longitudinal face of the cross wall 28 opposite its face 43 so that the body is parallel to the axis 24. Referring to FIG. 5, a compressible ring 56 is seated in a ridge circumscribing the periphery of the body 50 and bears against the opening in the cross wall 28 through which the body is inserted to retain the member 49 in the cross wall. As shown in FIG. 4, when the body 50 of the stop member 49 is inserted into the cross wall 28 (seen only in FIG. 1), the end of the member which carries the flats 54 is received in an elongated passage 57 on the face 47 of the block 42. The passage 57 extends a sufficient distance in the face 47 so there is no interference between the stop member 49 and the block 42 as the block is displaced towards the connector 16 (seen only in FIG. 1). However, once the block 42 is displaced full forwardly towards the connector 16 of FIG. 1, the plate 38 (see FIGS. 1 and 2) at end of the actuator shaft 36 of FIGS. 1 and 2 contacts the flat 54 on the stop member 49 aligned opposite the plate.

The depth of the flat 54 aligned opposite the plate 38 (see FIGS. 1 and 2) determines the limit of the forward travel of the block 42. The deeper the flat 54, the greater the forward travel of the block 42 and, conversely, the shallower the flat, the shorter the forward travel of the block. As will be appreciated, the length of the forward travel of the block 42 determines how far the blade 45 is inserted into the recess 14 (see FIG. 1) in the connector 16 (see in FIG. 1). By rotating the stop member 49 to align a deeper or shallower one of the flats 54 opposite to the plate 38, the travel of the blade 45 into the recess 14 can be made deeper or shallower, thus permitting the apparatus 10 to accommodate different types of connectors 16 whose recesses have different depths.

Figure 6:
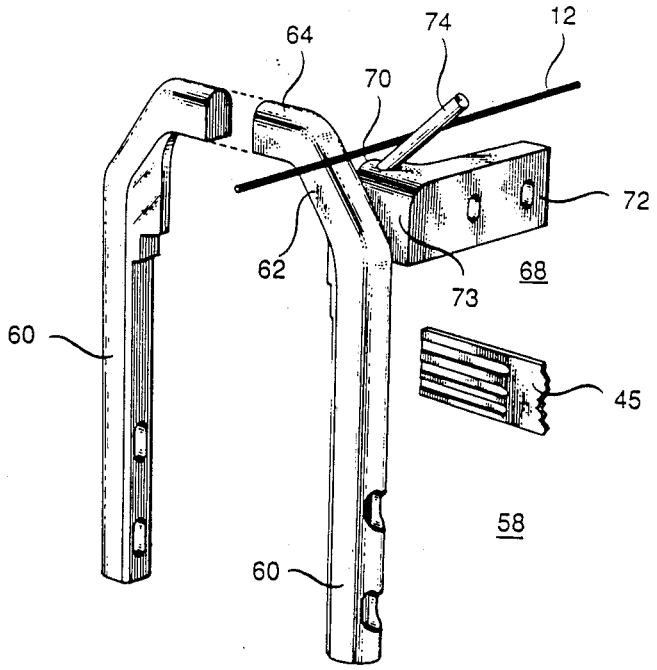
FIG. 6 is a perspective view of one and a portion of another of a pair of wire guides on the apparatus of FIG. 1.

Referring to FIG. 1, in order for each wire 12 to be properly rammed by the blade 45 of each ram assembly 32 into a corresponding recess 14 in the connector 16, the wire must be aligned with the blade. For this purpose, the apparatus 10 is provided with a pair of wire guides 58, whose details may best be seen by reference to FIGS. 6 and 7. As seen in FIG. 6, each wire guide 58 comprises a vertical column 60 having an upwardly sloping portion 62 at a height well above that of the carriage 26 of FIG. 1. Above the upwardly sloping portion 62 of the column 60 is a transversely extending portion 64. As seen in FIG. 1, each column 60 is secured to a separate one of the sides of the long wall 20 a short distance rearwardly (towards the bottom of FIG. 1) from a separate one of the cross wall 28 such that the transverse portion 64 extends the over the long wall towards the transverse portion of the other column.

Figure 7:
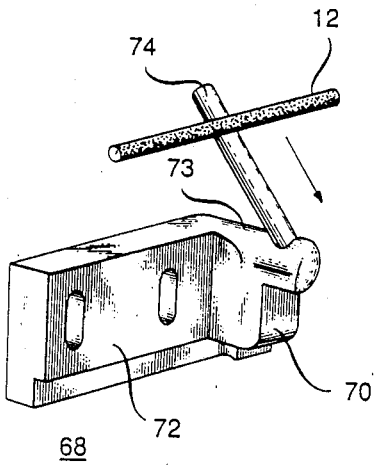
FIG. 7 is a perspective view of a block comprising part of the wire guide of FIG. 6.

Each wire guide 58 also includes a prismatically shaped block 68, which, as seen in FIG. 7, has a boss 70 protruding horizontally from one of the longitudinal faces 72 so as to be flush with an end 73 of the block. The block 68 of each wire guide 58 is secured to each cross wall 28 (see FIG. 1) at its end abutting the long wall 20 (see FIG. 1) so the end 73 of the block is aligned above the blade as seen in FIG. 7. As shown in FIG. 1, when the block 68 is mounted to the cross wall 28 in this fashion, the boss 72 overlies a portion of the carriage 26 as it travels along the axis 24 past the ram assemblies 32.

As best seen in FIGS. 6 and 7, a pin 74 extends upwardly at an inclined angle, typically 45°, from the boss 72 on the block 68. The pin 74 extends in a direction opposite the pin extending from the boss 72 on the other block 68 so the pins jointly form a part of a "V" as seen in FIG. 1. The pin 74 of each wire guide 58 serves as a guide to allow one of the wires 12 to be pulled downwardly thereacross by an operator, as seen in FIG. 7, to bring the wire against the upwardly sloping portion 62 of the column 60 as seen in FIG. 6. Once the wire 12 has been pulled against the upwardly sloping portion 62 of the column 60, the wire can then be manually pulled downwardly therealong towards the end 73 of the block 68. The wire is then pulled downwardly, against the end 73 of the block 68, and into alignment opposite the blade 45.

As should be appreciated, as the wire 12 is pulled downwardly along the pin 74, then downwardly along the sloped portion 62 of the column 60, and finally, downwardly along the end 73 of the block 68, gravity is acting on the wire, making the task of pulling the wire easier. Further, pulling the wire 12 downwardly along the pin 74 and along the sloped portion 62 of the column 60 is a more natural motion for the operator, as compared to that required by the wire guide arrangement taught in the aforementioned Muhlberger et al. application.

Figure 8:
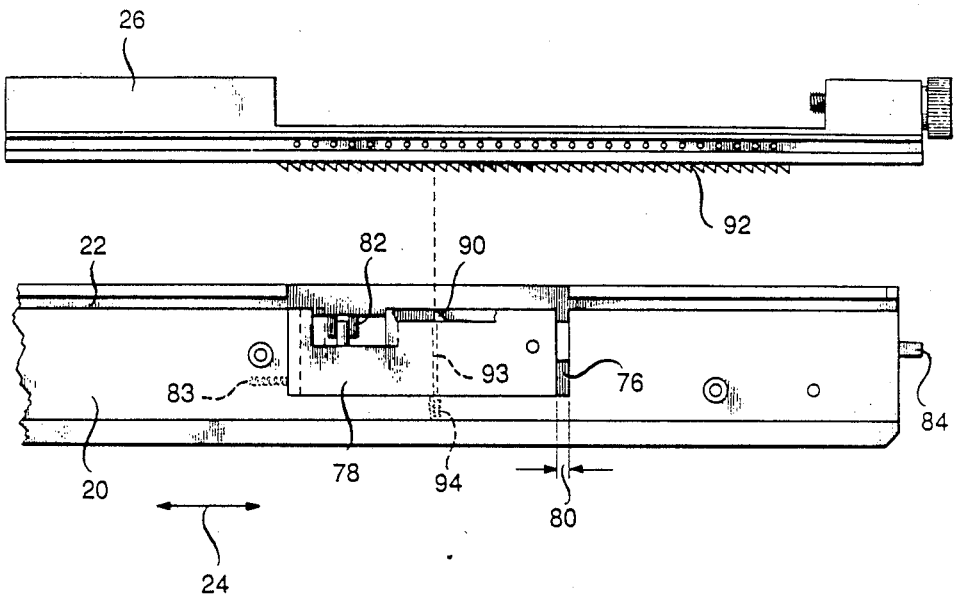
FIG. 8 is a side view in elevation of a portion of the apparatus of FIG. 1 showing the details of a carriage and a mechanism for advancing the carriage.
Figure 9:
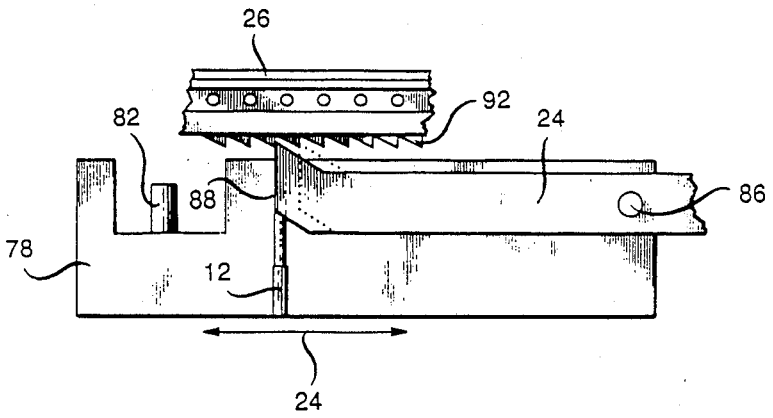
FIG. 9 is an enlarged view of a portion of FIG. 8, showing additional details of the carriage-advancing mechanism.

Referring to FIGS. 8 and 9, there is shown the details of how the carriage 26 is advanced along the track 22 to bring a successive pair of opposed recesses 14 (see FIG. 1) on the connector 16 (see FIG. 1) into alignment with a separate one of the blades 45 (see in FIGS. 1-3). As best seen in FIG. 8, within the long wall 22, there is a cutout 76 within which is a traveler 78. The traveler 78 is of a length less than the length of the cutout 76 so that a gap 80 exists therebetween, thus allowing the traveler to move back and forth a short distance along the axis 24.

On the traveler 78, there is an upwardly rising pin 82 which is connected by a lever and cam arrangement (not shown) to one of the actuators 34 of FIGS. 1 and 2 which, as will be described, are operated in unison. The manner in which the pin 82 is coupled to the one actuator 34 is such that when the actuator 34 displaces its corresponding block 42 (see FIG. 1) towards the connector 16 (see FIG. 1), the traveler 78 is displaced in a rightward direction in FIGS. 8 and 9. Conversely, when the actuator 34 is actuated in the opposite direction, to displace its corresponding block 42 away from the connector 16, the traveler 78 is displaced leftwardly. Referring to FIG. 8, a spring 83 is partially embedded in an opening in the left-hand side of the cutout 76 in the cross wall for biasing the traveler 78 in a rightward direction.

As best seen in FIG. 9, a lever 84 is journaled by a pin 86 to the traveler 78 a short distance from a first end 88 of the lever so that this end can move generally up and down. A spring (not shown) is provided for biasing the end 88 of the lever 84 generally upwardly. On the upper edge of the end 88 of the lever 84 is a pair of spaced teeth 90, only one of which is seen in FIG. 9, the other being spaced deeper into the plane of the figure. The teeth 90 are sized to mesh with a set of teeth 92 running along the base of the carriage 26.

Situated between the two teeth 90 is the upper, sloped end of a vertical post 93 which passes downwardly through the traveler 78 and into the long wall 20. Like the teeth 90, the sloped upper end of the post 93 is sized to mesh with the teeth 92 on the base of the carriage 26. An elongated opening (not shown), of a sufficient length, is provided in the traveler 78 for receiving the post 93 to permit the traveler to move back and forth in the opening 76 along the axis 24 without any interference with the post. A spring 94 is interposed between the lower end of the post 93 and the long wall 20 to bias the post in an upward direction.

The manner in which the carriage 26 is incrementally advanced to bring each of a successive pair of recesses 14 (see FIG. 1) on the connector 16 (see FIG. 1) into alignment with the ram assemblies 32 (see FIG. 1) may be understood by reference to FIG. 9. As depicted in that figure, the traveler 78 is at its leftmost position, which occurs when the blades 45 (see FIG. 1) of the ram assemblies 32 are retracted away from the connector 16 of FIG. 1. As the actuators 34 of FIG. 1 are actuated to displace their blades 45 towards the connector 16, the traveler 78 moves rightwardly in FIG. 9. Consequently, the teeth 90 on the end 88 of the lever 84 slip past the tooth 92 on the carriage 26 they had previously engaged. The teeth 90 on the end 88 of the lever now engage the next tooth 92 on the carriage 26 immediately to the right of the one just engaged. The carriage 26 however remain stationary because the sloped upper end of the post 93 still engages the tooth 92 to the left of the one now engaged by the teeth 90 on the end 88 of the lever 84.

Once the actuators 34 are actuated to retract their blades 45 from the connector, the traveler 78 now moves leftwardly. As the traveler 78 moves leftwardly, the teeth 90 on the end 88 of the lever 84 remain in firm engagement with the tooth 92 on the carriage 26. Thus, as the traveler 78 moves leftwardly, so too does the carriage 26. The sloped upper end of the post 93, which had previously engaged one of the teeth 92 on the carriage, now slips over the tooth to engage the one immediately to the right of it.

This incremental motion of the carriage 26 is repeated each time the actuators 34 are actuated n unison to ram each pair of wires 12 into a corresponding pair of recesses 14. To manually move the carriage 26 back to its original position, the lever 84 is manually pivoted to displace its end 88 downwardly to engage a boss 96 on the post 93 to bias the post downwardly, thus disengaging its upper end from the teeth 92 on the carriage 26.

Referring to FIG. 1, attachment of each of the pair of wires 12 to the contact 13 in each of a pair of opposed recesses 14 in the connector 16 is accomplished by first manually pulling each wire into alignment with each blade 45 in the manner described above. Once aligned, the wires 12 are each manually tensioned by an operator while the actuators 34 in unison are actuated to ram the wires into an opposed pair of the recesses 14 for attachment to the contacts 13. Once attachment of the pair of wires 12 has been completed in this manner, the carriage 26 is automatically advanced in the manner described previously to align each of another pair of opposed recesses 14 opposite the blades 45. The procedure is then be repeated until all of the contacts 13 are attached to their corresponding wires 12.

The foregoing describes an improved apparatus 10 for attaching each of a successive pair of wires 12 to a successive pair of contacts 13 of a connector 16.

It is to be understood that the above-described embodiments are merely illustrative of the principles of the invention. Various modifications and changes may be made thereto by those skilled in the art which will embody the principles of the invention and fall within the spirit and scope thereof.

We claim:

1. A method for attaching successive pairs of wires to successive pairs of contacts seated in opposing recesses spaced along each of a pair of parallel rows on a connector, comprising the steps of:

placing the connector on a slidably mounted carriage so that each of a pair of opposed recesses in the connector is opposite a separate one of a pair of ram assemblies which are movable to and from the connector;

manually pulling each of a pair of wires downwardly across each of a pair of upwardly inclined members, and then pulling the wires downwardly into alignment with each of the ram assemblies;

manually holding each pair of wires in tension while displacing each ram assembly towards the contact opposite thereto to ram the wire into the contact for attachment thereto;

adjustably limiting the travel of each ram assembly into the recess to control the extent to which each wire is rammed;

retracting each of the ram assemblies once each of the pairs of wires has been rammed into a separate one of the recesses; and advancing the carriage along its axis of travel to locate each of a successive pair of recesses in the connector opposite a separate one of the ram assemblies.

2. The method according to claim 1 wherein the steps of the method are repeated until each of a plurality of wires is attached to a separate one of the connector contacts.

* * * * *